US011828033B1

(12) United States Patent
Khedmatgozar Dolati et al.

(10) Patent No.: US 11,828,033 B1
(45) Date of Patent: Nov. 28, 2023

(54) GROUTED SLEEVE COUPLER SPLICE (GSCS) FOR PRECAST CONCRETE PILES

(71) Applicants: Seyed Saman Khedmatgozar Dolati, Miami, FL (US); Armin Mehrabi, Miami, FL (US)

(72) Inventors: Seyed Saman Khedmatgozar Dolati, Miami, FL (US); Armin Mehrabi, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 18/190,262

(22) Filed: Mar. 27, 2023

(51) Int. Cl.
*E02D 5/58* (2006.01)
*E02D 5/30* (2006.01)
*E02D 5/52* (2006.01)

(52) U.S. Cl.
CPC ..... *E02D 5/526* (2013.01); *E02D 2600/20* (2013.01)

(58) Field of Classification Search
CPC .. E02D 5/526; E02D 5/30; E02D 5/58; E02D 2600/20
See application file for complete search history.

(56) References Cited

U.S. PATENT DOCUMENTS 4,050,211 A * 9/1977 Wahman ..... E02D 5/523 403/294
11,319,689 B1 * 5/2022 Mehrabi ..... E02D 5/526
11,319,706 B1 * 5/2022 Khedmatgozar Dolati ..... E04C 3/36
2011/0002744 A1 * 1/2011 Tadros ..... E02D 5/58 405/232
2022/0341117 A1 * 10/2022 Zhou ..... E02D 5/48

FOREIGN PATENT DOCUMENTS

CN 107882019 A * 4/2018 ..... E02D 5/30
CN 110029667 A * 7/2019 ..... E02D 31/06
CN 114718059 A * 7/2022

* cited by examiner

*Primary Examiner* — Frederick L Lagman
*Assistant Examiner* — Stacy N Lawson
(74) *Attorney, Agent, or Firm* — Saliwanchik, Lloyd & Eisenschenk

(57) ABSTRACT

The subject invention pertains to a completely new pile splicing system called Grouted Sleeve Coupler Splice (GSCS) for Precast Concrete Piles (PCPs) as an innovative alternative splicing method for connecting driven PCP segments. The provided splicing method is applicable for preplanned situations and provides a durable, labor-friendly, rapid, and economical foundation construction method. In this system, to improve the structural performance, the entire sleeve coupler and a portion of the dowels are partially debonded in short lengths from surrounding concrete. This connection system is novel in conjunction with PCPs and for connecting separate precast pile segments. The provided system offers a completely unique and new method of connecting and splicing PCP segments and other prismatic prefabricated piles.

20 Claims, 7 Drawing Sheets

GROUTED SLEEVE COUPLER SPLICE (GSCS) FOR PRECAST CONCRETE PILES

GOVERNMENT SUPPORT

This invention was made with government support under 69A3551747121 awarded by the Department of Transportation. The government has certain rights in the invention.

BACKGROUND

Precast Concrete Piles (PCPs) are the most common method for establishing the foundation of bridges and tall buildings. For many reasons, including shipping and transportation limitations, variable and unforeseen soil conditions, easy handling and driving, and reduction in the probability of cracks in concrete, it is desirable or mandatory to cast piles with shorter lengths and connect them at the site. Hence, splicing of pile segments has to be performed at the site to achieve longer lengths. However, some shortcomings and challenges are associated with related art splice systems which have limited their applications. For instance, welded splices cannot be used (or may have concerns) in corrosive areas such as the marine environment as corrosion can cause premature failure of the splice system. Other mechanical and wedge splices need careful and quality fabrication at a prestressing plant that are not a labor-friendly method of connection and may increase the cost dramatically. Epoxy dowel splicing is a time-consuming and sometimes complex process as the crane is required for a long period of time for the installation. These shortcomings and challenges put tremendous pressure on providing an alternative splicing method to be durable, labor-friendly, economical, and time effective.

BRIEF SUMMARY

Grouted sleeve couplers, as a type of mechanical bar couplers, have been used widely for connecting reinforcing bars. A majority of their application have been associated with cast-in-place concrete structures, where the reinforcing bars are fully coupled together before the concrete is poured. They have also been utilized for connecting prefabricated cap beam to cast-in-place or precast concrete columns. Additionally, they have been implemented to connect precast columns to cast-in-place or precast footing, and shear walls segments.

The grouted sleeve couplers are novel for use in conjunction with PCPs. Furthermore, grouted sleeve couplers are novel for connecting any separate precast pile segments. The features and benefits provided by embodiments of the subject splicing system and method are not found in related art systems. Embodiments of the provided system offer a thoroughly unique, new, and advantageous method of connecting PCP segments (e.g., splicing) and numerous other prismatic or non-prismatic prefabricated piles.

Embodiments of the subject invention are superior to related art methods because: a) they are simpler to apply; b) they require fewer modifications to the pile segments; c) they advantageously apply labor-friendly and time-effective methods of construction; d) when combined with corrosion resistant coupler and dowel material, certain embodiments provide better durability and corrosion-resistance and will perform better in corrosive settings such as marine environments; e) embodiments provide for the required strength rapidly to allow driving of the pile to continue with shorter delays; f) embodiments improve the structural performance over related art mechanical splices because of debonding of coupler and partial debonding of the dowel; and g) embodiments develop the required strengths with a smaller size or number of bars, making an advantageously economical splicing method.

Embodiments of the subject invention considerably enhance the construction operation for splicing precast piles, and significantly improve the strength and durability of spliced piles. The durability of pile splices in marine and corrosive environments can also be increased remarkably.

DETAILED DESCRIPTION

Figure 1A:
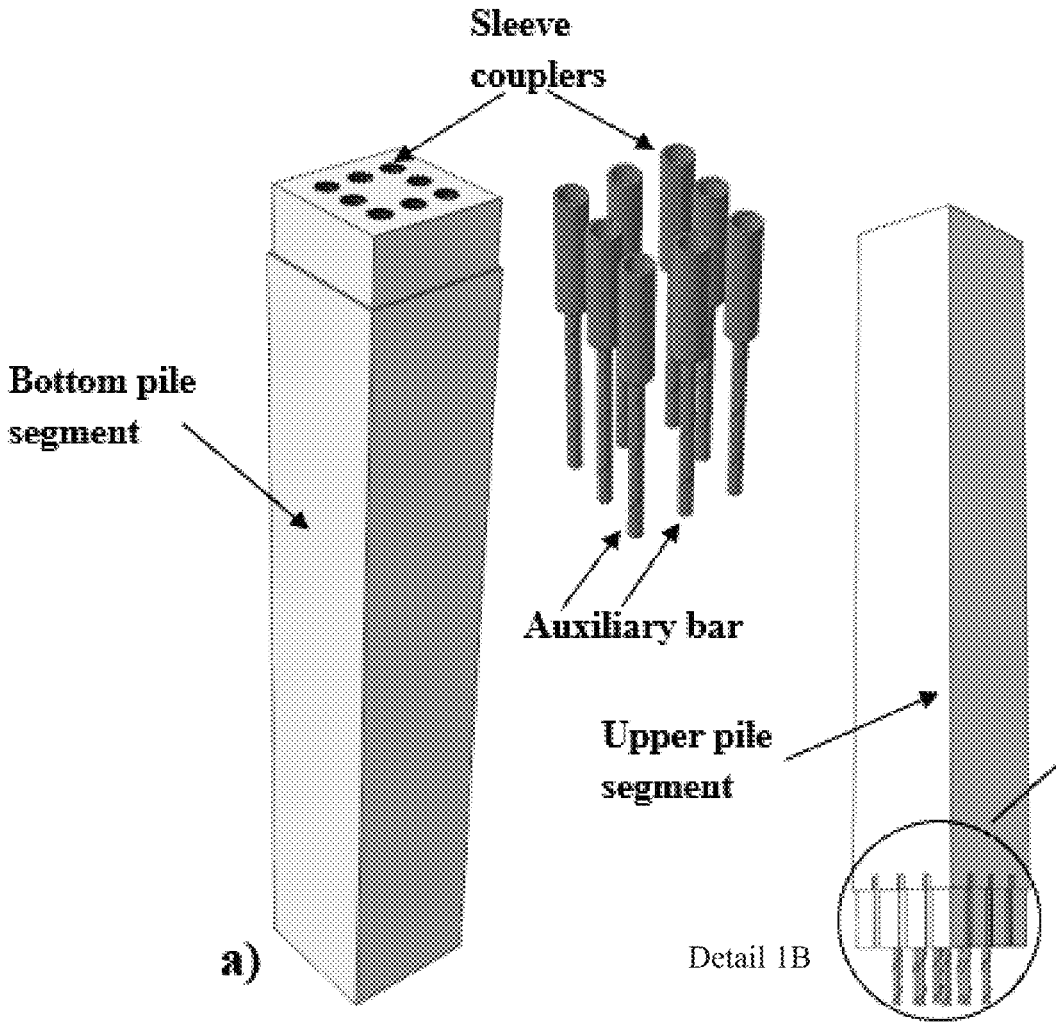
FIG. 1A illustrates a bottom pile segment, an upper pile segment, sleeve couplers, and auxiliary bars for a Grouted Sleeve Coupler Splice (GSCS) for Precast Concrete Piles (PCP) according to an embodiment of the subject invention.

Embodiments of the subject invention provide a novel pile splicing system called Grouted Sleeve Coupler Splice (GSCS) for Precast Concrete Piles (PCPs) as an innovative improved splicing system/method for connecting driven PCP segments. Embodiments of the provided splicing method are applicable for preplanned situations and can provide a durable, labor-friendly, rapid, and economical foundation construction method. In certain embodiments, to improve the structural performance, the entire sleeve coupler and a portion of the dowels are partially debonded in short lengths from surrounding concrete.

A jacket recess (e.g., as shown throughout the Figures) can be an area of reduced cross section at an end of a PCP section, sized for insertion into a jacket (e.g., an FRP jacket, alternatively a galvanized or stainless steel jacket) of matching size. A jacket recess can have a depth (e.g., ⅜", alternatively between ¾" and 1") and the depth in certain embodiments can be equal to the thickness of FRP Jacket specified by the designer. A jacket recess can have features such as grooves, ridges, and corner treatments including chamfers and rounds. A jacket and jacket recess can be designed together to provide a space for grout, resin, bonding agents, or adhesives between them (e.g., uniform or variable spacing from essentially zero to ⅛", ¾", ⅜", ½" or more.) Tolerances between a jacket and one or more jacket recesses can be represented as an absolute value (e.g., +/−⅛", alternatively +/−1/16", +/−1/32", or +/−1/64") or as a fraction of the depth or length of the jacket recess or the jacket length, jacket thickness, or jacket width (e.g., +/−0.001 times, +/−0.01 times, +/−0.1 times.)

A coupler bore can be a drilled or formed hole in the PCP segment, configured and adapted to receive a coupler. In certain embodiments, coupler bores are arranged in a pattern (e.g., three rows of three, or a first outer row of three, a first inner row of two, and a second outer row of three) across a face on an end of a PCP segment.)

A sleeve coupler, such as a debonded grouted coupler, can have an auxiliary bar attached by grout or mechanical means, and the coupler can be debonded from the PCP segment while the auxiliary bar can be debonded within the coupler, but bonded to the PCP segment beyond the coupler. A sleeve coupler can be disposed within a respective coupler bore, and configured and adapted to receive a dowel in addition to any auxiliary bar, then to couple the dowel and the bar together by a bonding grout or resin. A sleeve coupler can be made from, for example, FRP, galvanized steel, stainless steel, and regular steel.

A dowel can extend downward from a bottom face beyond an interior volume of a PCP pile segment. A dowel can debonded from the PCP pile within a debonded area within the interior volume of the PCP pile (e.g., proximal to the bottom face), and a dowel can be bonded to the PCP pile outside the debonded area. A dowel can be made from, for example, FRP, galvanized steel, stainless steel, and regular steel.

Exemplary and non-limiting examples of products and materials suitable for use as a debonding cover include, for example, Teflon, epoxy coating, or plastic sleeve.

An enclosed grout pocket connecting the top face, the plurality of sleeve couplers, the bottom face, and the plurality of dowels can be a volume configured and adapted to receive a bonding grout or other suitable material. The enclosed grout pocket need not by fully sealed off, but can be configured and adapted (e.g., with tolerances of openings or gaps chosen to match flow characteristics of a bonding grout) to facilitate forming a splice.

Lengths that are set to the same value means those lengths are specified as equal to within normal construction tolerances as would be recognized by one of ordinary skill in the art, working in the field of commercial construction using PCPs, for instance +/−0.125 inches for the length of a #8 reinforcing bar, a recess length, a debonding cover, or a debonded area in a PCP.

A sleeve coupler in certain embodiments cannot protrude beyond the top face of the bottom PCP, and cannot be recessed with a sleeve couple bore below the top face of the bottom PCP.

When the top face is brought into juxtaposition with the bottom face, this means assembly of the splice, including control of alignment, distance/offset/spacing, or contact between two piles.

Embodiments are well suited to application in prismatic piles of numerous shapes and sizes. Particularly advantageous applications include rectangular, octagonal, or any regular cross section including circular cross section. Embodiments are also well suited to non-prismatic pile applications including, for example, tapered piles.

Positioning of certain features such as grout sleeve, dowel, FRP jacket, and grooves can be devised to facilitate the application of filler material and to assure that all voids are completely filled (e.g., with gravity working in favor of filling.) All the features provided with respect to the bottom pile can theoretically be also implemented in a top pile provided that measures to assure complete filling are implemented. Accordingly, in certain embodiments it can be more practical and advantageous to have certain features on either the upper or lower pile (e.g., as shown in the embodiments illustrated by the appended figures. In certain embodiments with the grouting sleeves in a bottom segment and having their end at the level of the top surface of the bottom segment, there can advantageously be impeded, reduced, inhibited, or minimized negative interaction(s) with a driving hammer and conventional driving pads can therefore be used.

Once the splice is made, in certain embodiments the newly spliced upper and bottom pile segments can together be advantageously treated as a new lower pile segment to be driven deeper into the ground, providing beneficial modularity and scale to certain embodiments.

In certain embodiments processing occur horizontally instead of vertically, or at a range of angles, with conditions such that the complete filling of the sleeves can be promoted, enhanced, encouraged, or assured. The filling of voids with a bonding material is, in certain embodiments driven, enhanced, encouraged, or facilitated by gravity. In certain embodiments the bonding grout or resin is advantageously inhibited, prevented, or restrained from entering into the debonded area of the dowels in the bottom face of the upper pile. In certain embodiments the tolerance of overall dimensions of FRP jacket (except the thickness) can be +/−0.125 inch, and the grooves can be 0.5 inch wide and ⅜ inch deep.

The provided connection system is novel for use in conjunction with PCPs and for connecting any separate precast pile segments. Embodiments of the provided system offer a completely unique and advantageous new method of connecting PCP segments (e.g., splicing) and numerous other prismatic prefabricated piles.

Embodiments of the provided splice system have certain features that are advantageous over related art splicing methods. In certain embodiments these features can include the following.

In certain embodiments the entire set of grouted sleeve couplers (alternatively, at least one coupler and/or a fraction of the couplers) and/or a portion of the dowels (alternatively, at least one dowel and/or the entire set of dowels) are debonded from the surrounding concrete to enhance the structural performance of the finished GSCS.

In certain embodiments, a provided FRP jacket prevents, reduces, or inhibits penetration and ingress of water, moisture, detrimental chemical, etc., into the splicing system. Accordingly, the provided FRP jacket acts as a corrosion-resistant barrier, enhancing the durability and service life of the splice system.

In certain embodiments, a provided FRP jacket performs as a framework of installation and bracing for the pile segments at the joint, ensuring, enhancing, improving, or encouraging the alignment and facilitating the assembling procedure. The FRP jacket also improves the bond between the precast pile segments. When the dowels are placed inside the grouted sleeve couplers, the adhesive materials inside the couplers can be squeezed out and flow out (e.g., from one or more grooves cut in the upper recess area.) The provided FRP jacket acts as a restrainer for grouting or adhesive, prevents the loss of grout materials at the splicing section, and avoids, reduces, or inhibits formation of voids at the splicing section. The provided FRP jacket adds to the shear capacity of the joint: The FRP jacket adds to the shear capacity provided by the dowels and therefore, improves the shear capacity of the splice system. In the same way, the FRP jacket can also enhance the flexural strength of the splicing system.

In certain embodiments the provided recesses on the sides of precast pile segments (FIGS. 1A, 1B, and 2) provide better attachment of the FRP jacket to the pile segments, preventing, reducing, or inhibiting projection of the precast pile segments out of the cross-section and preventing, reducing, or inhibiting damage during pile driving.

Figure 2:
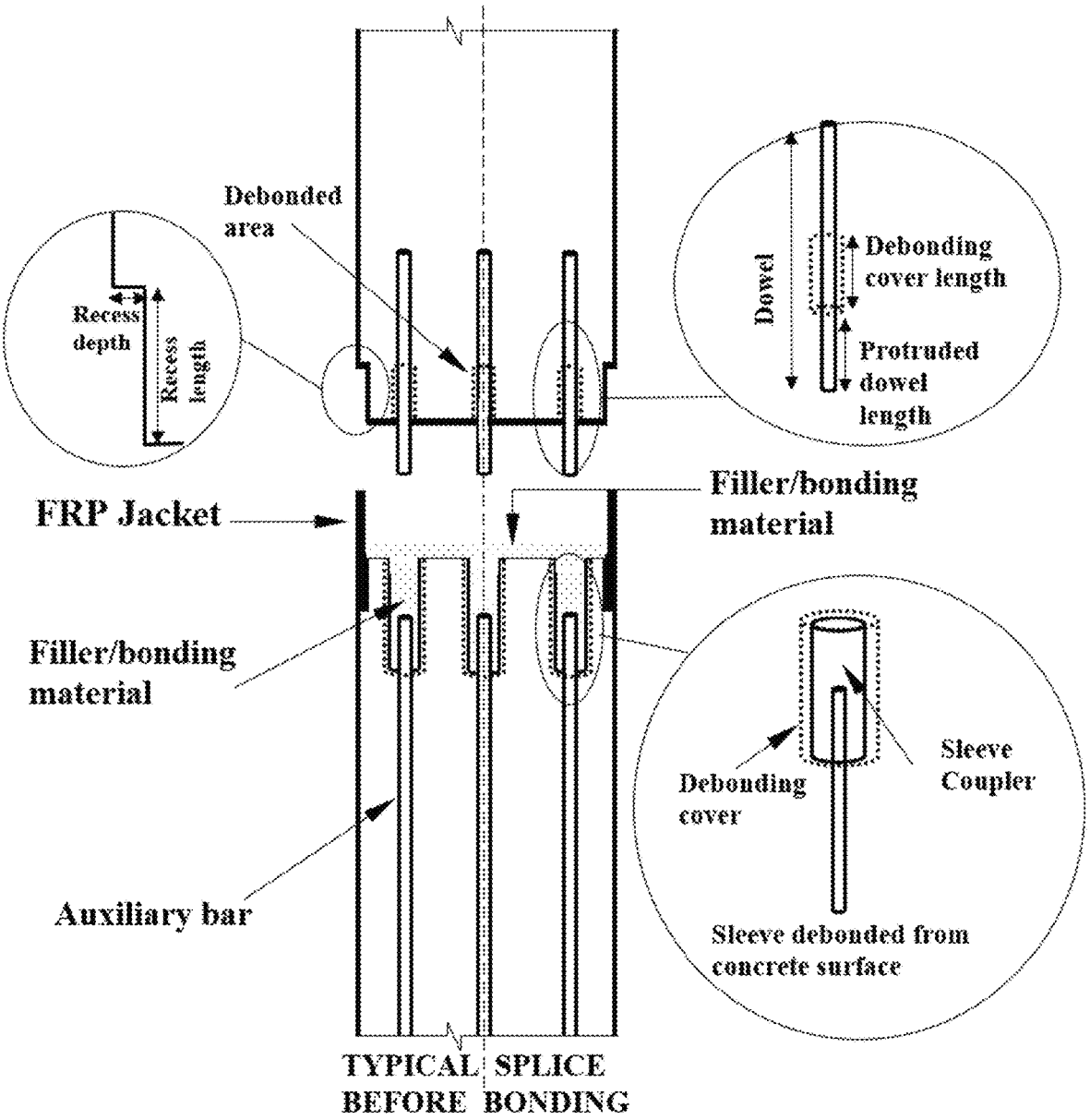
FIG. 2 illustrates an elevation view showing internal and external construction and assembly details before bonding for a GSCS for PCP according to an embodiment of the subject invention.
Figure 3:
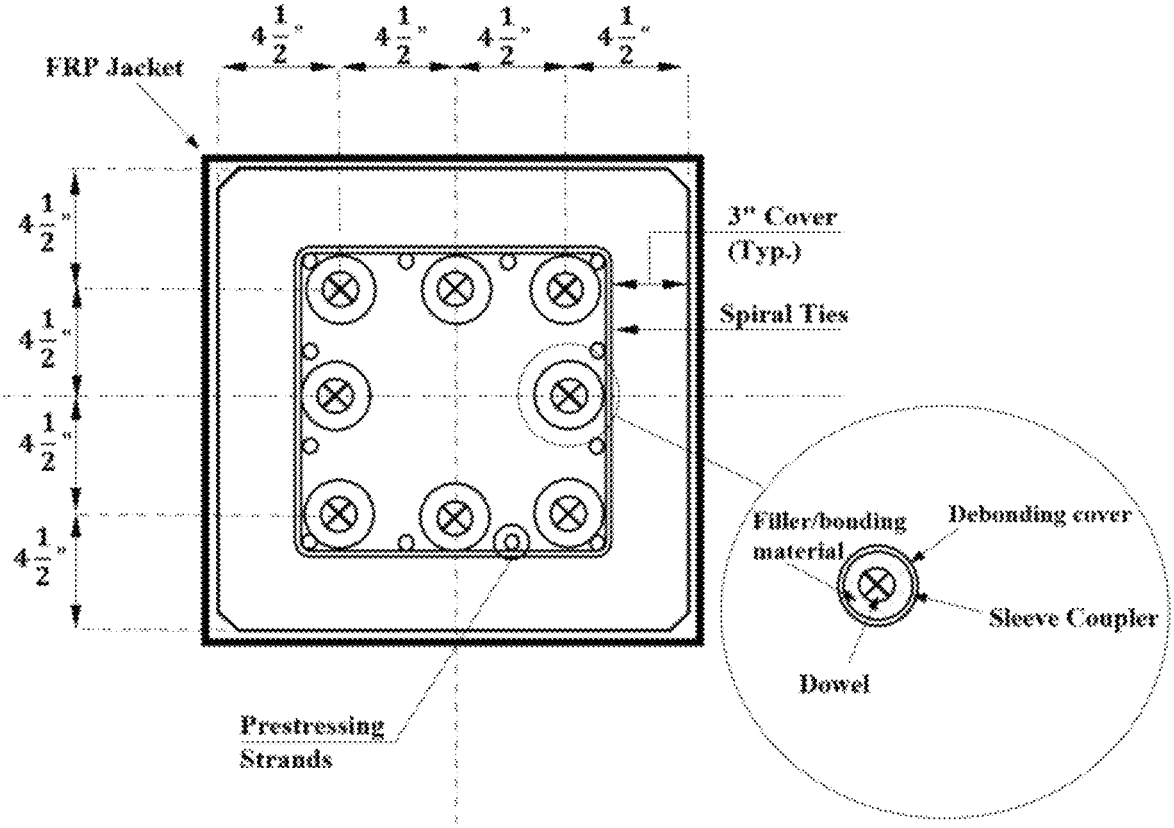
FIG. 3 illustrates a plan view showing construction and layout details for a GSCS for PCP according to an embodiment of the subject invention. Though FIG. 3 lists certain dimensions, these are for exemplary purposes only and should not be construed as limiting.

Embodiments of the subject invention provide a reinforcement arrangement such that the grouted sleeve couplers, which can be advantageously positioned at the bottom pile segment and connected to auxiliary bars (FIGS. 1A and 2), are placed on, near, or adjacent one or more of the far left, right, top, or bottom positions, respectively, of the cross-section, optionally in a pattern having symmetry about one plane, symmetry about two planes, radial symmetry, and/or asymmetric, patterned, or irregular geometry (FIG. 3). The sleeve couplers in certain embodiments can be placed a minimum cover distance away from one or more outer edges of the GSCS (e.g., 3" Cover, as shown in FIG. 3.) The arrangements in certain embodiments can provide a higher moment capacity through producing a larger moment arm. Accordingly, the provided arrangements can allow designing the splice system with a smaller number and size of bars and couplers, making it even more economical.

Embodiments of the subject invention provide several advantages over related art methods and can provide numerous beneficial impacts on the construction field. Embodiments of the provided GSCS are superior to related art methods because; a) embodiments of the GSCS are simpler to apply, b) embodiments of the GSCS require few, minimal, or no modifications to the pile segments, c) embodiments provide a labor-friendly and time-effective method of construction, d) when combined with corrosion resistant coupler and dowel material, certain embodiments provide better durability and corrosion-resistance and will perform better in corrosive settings such as marine environment, e) embodiments provide for the required strength to be rapidly attained to allow driving of the pile to continue, f) embodiments improve the structural performance over related art mechanical splices, due at least in part to debonding of coupler and partial debonding of the dowel, g) embodiments develop the required strengths with a smaller size or number of bars, providing a more economical splicing method.

Embodiments of the GSCS concept were developed as an innovative alternative to related art systems to connect precast pile segments. Employing certain embodiments of this splice system requires the preparation of pile segments at a precast plant and installation procedure at the site.

Figure 1B:
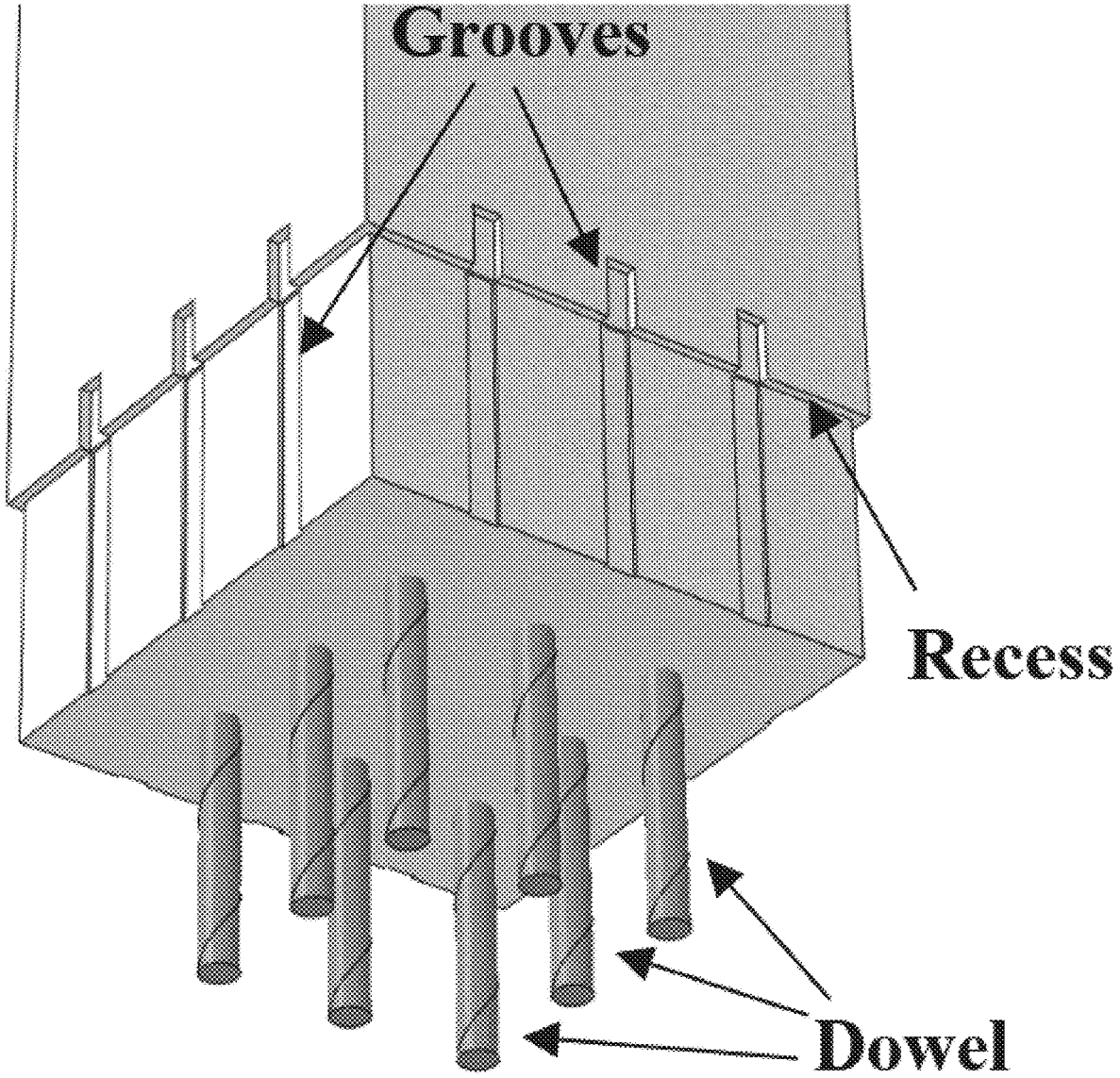
FIG. 1B illustrates a detailed view of an upper pile segment having a recess, grooves, and dowels for a GSCS for PCP according to an embodiment of the subject invention.

In one exemplary and non-limiting embodiment, the preparation procedure at a precast plant includes:

P1) Casting the upper concrete pile segment with dowels protruding from the bottom surface (FIG. 1B). A part of the dowels inside the pile segment can be covered by a debonding layer to be debonded from the surrounding concrete (FIGS. 2-3). The cross-section at the end of this segment where dowels exit can be formed with a recess on all sides with a specified length and grooves for discharge of excess grouting or resin to be implemented during splicing (FIGS. 1B, 2). The length of the protruded dowels, dowel debonded areas, and recesses can advantageously be set to the same value for construction simplicity;

P2) Casting the lower concrete pile segment with grouted sleeve couplers connected to auxiliary bars. Grouted sleeve couplers can be connected to auxiliary bars through either threading or grout material. The cross-section at the end of this segment where couplers are cast can have a recess on all sides with a specified length (FIG. 1A). The entire set of grouted sleeve couplers can be debonded from the surrounded concrete using low friction coating (FIG. 2); and P3) Fabricating an FRP jacket with a width and length selected to cover the pile segments recesses and straddle the splice section (FIG. 1C).

Figure 1C:
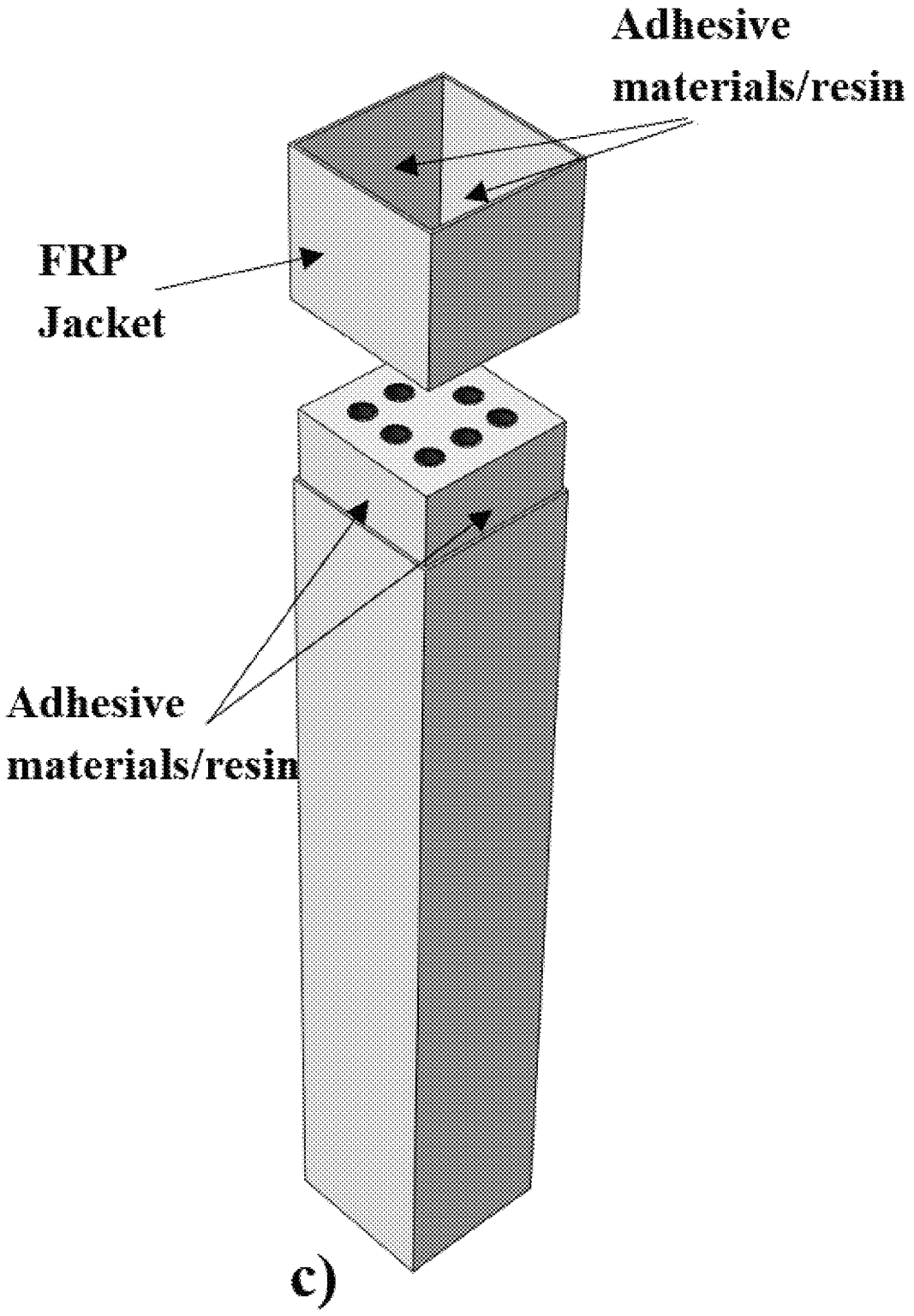
FIG. 1C illustrates a bottom pile segment, a fiber reinforced polymer (FRP) jacket, and application areas for adhesive material and/or resin for a GSCS for PCP according to an embodiment of the subject invention.
Figure 1D:
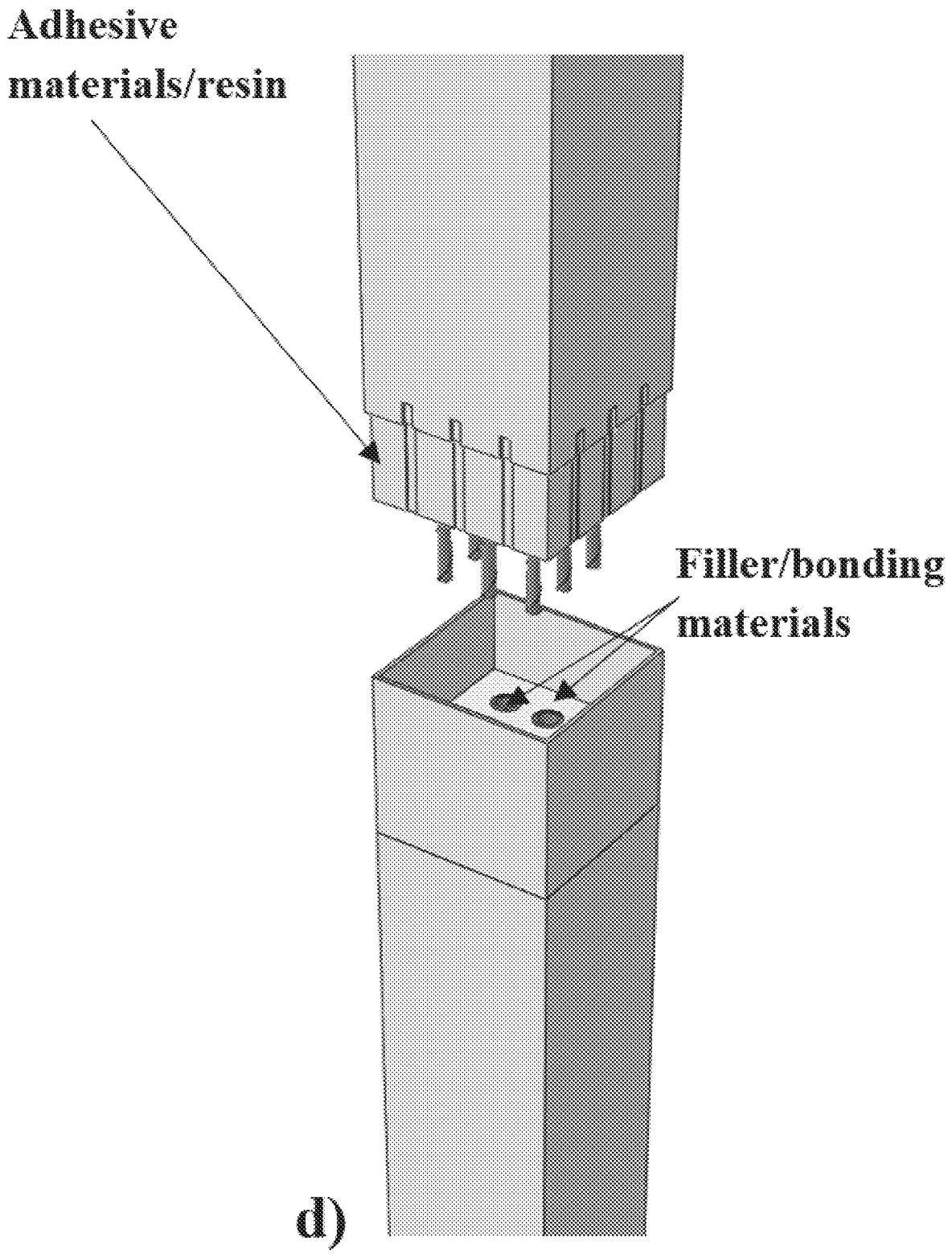
FIG. 1D illustrates a bottom pile segment, an upper pile segment, an FRP jacket, and application areas for adhesive materials and/or resin, and for filler and/or bonding materials for a GSCS for PCP according to an embodiment of the subject invention.
Figure 1E:
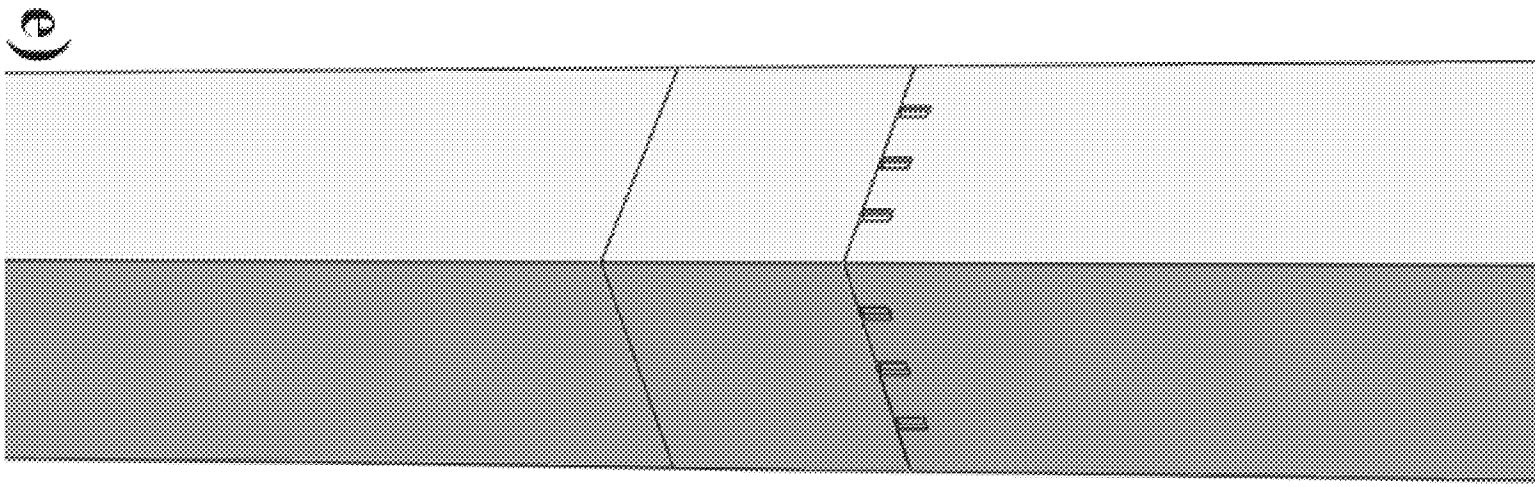
FIG. 1E illustrates an assembly of a bottom pile segment, an upper pile segment, and an FRP jacket for a GSCS for PCP according to an embodiment of the subject invention.

The segments are then moved to the field for installation. The field installation procedure includes:

F1) Driving the bottom pile segment into the ground (e.g., through a driving hammer) (FIG. 1A);

F2) Applying adhesive materials and/or resin to the recessed areas of the bottom pile segment (FIG. 1C);

F3) Applying adhesive materials and/or resin to the inside perimeter of the FRP jacket (FIG. 1C);

F4) Inserting the FRP jacket on to the bottom pile segment (FIG. 1C);

F5) Pouring or injecting adhesive and/or grout materials (e.g., epoxy or cementitious-based material) into the sleeve couplers and to the top surface of the bottom pile segment (FIG. 1D);

F6) Applying adhesive materials and/or resin to the recessed areas of the upper pile segment (FIG. 1D); and F7) Lowering the upper pile segment on top of the bottom pile segment while placing the dowels into the grouted sleeve couplers (FIGS. 1D, 1E). The dowels protruded from the upper pile segment are fully inserted into the grouted sleeve couplers positioned at the bottom pile segment to provide the required bond strength. Parts of pile segments where recesses exist are entirely placed inside the FRP jacket.

Embodiments of the subject invention provide a completely new pile splicing system called GSCS for PCPs as an innovative alternative splicing method for connecting driven PCPs segments. In certain embodiments the splicing method can be advantageously applied to preplanned situations and provides a durable, labor-friendly, rapid, and economical foundation construction method. In certain embodiments, to improve the structural performance, the entire sleeve coupler and at least part of the dowels are partially debonded in short lengths from surrounding concrete. This connection system is novel in conjunction with PCPs and for connecting separate precast pile segments. The provided system offers a completely unique and new method of splicing or connecting PCP segments and other prismatic prefabricated piles.

Many factors should be considered in designing the GSCS precast pile splice system, including but not limited to the mechanical properties of sleeve couplers, dowels, and auxiliary bars, the numbers and sizes of the sleeve couplers, dowels, and auxiliary bars in each side, couplers length and the required development length of the dowels and auxiliary bars, the dimension of recesses and FRP jacket, and the filler/bonding material properties. GSCS method for PCPs can also be implemented with reinforcing materials other than steel. Accordingly, sleeve couplers, dowels, and auxiliary bars can be made up of other materials including FRP, high strength steel, and stainless steel, etc.

As an example, in certain embodiments, for connecting 18 inch by 18 inch prestressed precast concrete pile segments, 8 number 8 dowels with projected length of 8 inches each can be used with grout sleeve with length of 18 inch and outside diameter of 2.5 inch. A recess on each segment with the length of 8 inch and 0.5 inch depth can be applied. An FRP jacket can be provided with the length of 16 inch and thickness of 0.5 inch. Grooves can be provided on the upper segment with the length of 8 inch, width of 0.5 inch, and depth of ⅜ inch.

Turning now to the figures, FIG. 1A illustrates a bottom pile segment, an upper pile segment, sleeve couplers, and auxiliary bars for a GSCS for PCP according to an embodiment of the subject invention.

FIG. 1B illustrates a detailed view of an upper pile segment having a recess, grooves, and dowels for a GSCS for PCP according to an embodiment of the subject invention.

FIG. 1C illustrates a bottom pile segment, an FRP jacket, and application areas for adhesive material and/or resin for a GSCS for PCP according to an embodiment of the subject invention.

FIG. 1D illustrates a bottom pile segment, an upper pile segment, an FRP jacket, and application areas for adhesive materials and/or resin, and for filler and/or bonding materials for a GSCS for PCP according to an embodiment of the subject invention. In certain embodiments the provided adhesive/resin and filler/bonding materials can be differentiated by their application. Adhesive/resin materials can be used to bond FRP to concrete surfaces and are applied in smaller thicknesses. Examples of adhesive/resin are polyester, epoxy, and vinyl ester. Filler/bonding material can be used to fill sleeves for receiving the dowels and to fill other voids left by construction tolerance. Examples of filler/bonding material are cement grout, polymer grout, and epoxy grout. In certain embodiments the type of material, constituent, mechanical properties, and performance of these two elements (adhesive/resin and filler/bonding) can be completely different.

FIG. 1E illustrates an assembly of a bottom pile segment, an upper pile segment, and an FRP jacket for a GSCS for PCP according to an embodiment of the subject invention.

FIG. 2 illustrates an elevation view showing internal and external construction and assembly details before bonding for a GSCS for PCP according to an embodiment of the subject invention.

FIG. 3 illustrates a plan view showing construction and layout details for a GSCS for PCP according to an embodiment of the subject invention.

Embodiments of the subject invention advantageously provide (either alone, or in combination) the use of grouted sleeve coupler(s) for precast concrete piles, the debonding of dowels, the debonding of the sleeve, the recess straddling the joint, the FRP Jacket crossing the joint, and the grooves for applying the filler/bonding material. In certain embodiments the relationship and formulation for detailing a specific coupler design can be based on or adapted to align with generally accepted engineering rules. The provided disclosure provides certain rules for selecting details such as debonding length, recesses (e.g., in certain embodiments equal to the thickness of FRP jacket, in alternate embodiments less than the thickness of FRP jacket, and in other alternate embodiments more than the thickness of FRP jacket), and grooves that are novel features of the provided system. In certain embodiments parameters such as dowel and sleeve length can be based on the couplers available in the market. Embodiments provide specific details, for example, auxiliary bar length, that can be designed according to the specific design requirement in each case, including for example, loading, environmental factors, and interaction with other adjacent structures.]

When ranges are used herein, such as for dose ranges, combinations and subcombinations of ranges (e.g., subranges within the disclosed range), specific embodiments therein are intended to be explicitly included. When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to embodiments of the invention.

Example 1: 18 ×18-Inch Florida Department of Transportation (FDOT) Standard Prestressed Precast Concrete Pile As a trial, based on the section analysis in American Concrete Institute (ACI) 318-19 (*Building Code Requirements for Structural Concrete*, ACI Committee 318, Publication Year: 2019), which is hereby incorporated herein in its entirety, a splice system according to an embodiment of the subject invention was designed for 18 ×18-inch FDOT standard prestressed PCP using 8-#10 bars (FIG. 3). As shown in FIG. 3, eight sleeve couplers are placed into three rows. Three of them in each of the first row and the last row, respectively, and two of them in the middle row.

For this system, for the sample 18 ×18-inch prestressed precast pile, a series of splice system designs using various bar numbers and sizes and corresponding sleeves were developed. The results are included in Table 1.

TABLE 1

Comparison of the moment, tension, and compression resistance for various numbers and sizes for bars

| Splice system using bars | | | ACI 318-14 | | | | FDOT Standard Design Specifications | | |
|---|---|---|---|---|---|---|---|---|---|
| Number | # Size | Nominal diameter of bar-in. | Development of Tension (%) | Development of Compression (%) | Development of Maximum Moment (%) | Development of Pure Moment (%) | Development of Tension (%) | Development of Compression (%) | Development of Pure Moment (%) |
| 8 | 8 | 1 | 89 | 112 | 100 | 81 | 130 | 110 | 82 |
| 9 | 8 | 1 | 100 | 112 | 100 | 85 | 146 | 110 | 86 |

TABLE 1-continued

| Comparison of the moment, tension, and compression resistance for various numbers and sizes for bars | | | | | | | | | |
|---|---|---|---|---|---|---|---|---|---|
| Splice system using bars | | | ACI 318-14 | | | | FDOT Standard Design Specifications | | |
| Number | # Size | Nominal diameter of bar-in. | Development of Tension (%) | Development of Compression (%) | Development of Maximum Moment (%) | Development of Pure Moment (%) | Development of Tension (%) | Development of Compression (%) | Development of Pure Moment (%) |
| 8 | 9 | 1.128 | 113 | 120 | 105 | 100 | 164 | 118 | 100 |
| 9 | 9 | 1.128 | 127 | 123 | 105 | 105 | 185 | 121 | 106 |
| 8 | 10 | 1.27 | 120 | 123 | 108 | 111 | 185 | 121 | 112 |

Table 1 indicates the capacity of the new splice system in developing the required tension, compression, and flexure (e.g., according to ACI and FDOT design specifications.) As shown in this table, splices with 8-#9, 9-#9, and 8-#10 bars can satisfy the requirements set forward by the cited design references.

Currently, FDOT utilizes epoxy-bonded dowel technique for splicing 18 ×18-inch square PCPs in which 8-#10 bars are used as dowels. With this arrangement, according to section analysis, the splice develops an average of 95% of pure moment demands required by design specifications. This is because of the fact that in the epoxy dowel technique, the bars cannot be placed in the farthest location as they require drilled/cast holes with much larger diameters to accommodate bar installation and adequate space for epoxy to flow. For the proposed splicing method, however, the splice can be performed with 8-9 #bars and with dowel length as a fraction of that for the epoxy dowel method. This saves cost and makes the installation much easier. It should be noted that the new system requires the use of auxiliary bars to develop the splice capacity into the pile segment and transfer the forces to the strands. Their development length should be calculated accordingly.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A Grouted Sleeve Coupler Splice (GSCS) system for Precast Concrete Piles (PCP), the system comprising:

a bottom PCP segment comprising:

a first pile body;

a top face at a top end of the first pile body;

a first jacket recess extending downward from the top face around a periphery of the first pile body;

a plurality of coupler bores extending downward from the top face within an interior volume of the first pile body;

a plurality of sleeve couplers; each disposed within a respective coupler bore and debonded from the first pile body; and a plurality of auxiliary bars; each disposed within a respective sleeve coupler and debonded from the first pile body within the respective coupler bore and bonded to the first pile body below the respective coupler bore; and a top PCP segment comprising:

a second pile body;

a bottom face at a bottom end of the second pile body;

a second jacket recess extending upward from the bottom face around a periphery of the second pile body; and a plurality of dowels extending downward from the bottom face beyond an interior volume of the second pile body, each respective dowel debonded from the second pile body within a respective one of a plurality of debonded areas within the interior volume of the second pile body proximal to the bottom face, each respective dowel bonded to the second pile body above the corresponding respective debonded area.

2. The system according to claim 1, further comprising:

a fiber reinforced polymer (FRP) jacket configured and adapted to connect the first jacket recess to the second jacket recess, forming an enclosed grout pocket connecting the top face, the plurality of sleeve couplers, the bottom face, and the plurality of dowels when the top face is brought into juxtaposition with the bottom face; and a bonding grout configured and adapted to fill the enclosed grout pocket.

3. The system according to claim 2, further comprising:

a controlled release mechanism configured and adapted to allow controlled release of excess bonding grout from the enclosed grout pocket under pressure.

4. The system according to claim 3, the controlled release mechanism comprising:

one or more grooves formed into the top PCP segment, the bottom PCP segment, or both;

each respective groove connecting a space within the enclosed grout pocket surrounded by the FRP jacket to a space beyond or outside of the FRP jacket.

5. The system according to claim 2, the plurality of coupler bores arranged on the top face in a first arrangement, and the plurality of dowels arranged on the bottom face in a second arrangement, such that when the top face is brought into juxtaposition with the bottom face, each respective dowel is aligned with and inserted at least partially into a corresponding respective coupler bore.

6. The system according to claim 5, the first arrangement being the same as the second arrangement.

7. The system according to claim 6, the first arrangement and the second arrangement being symmetrical with respect to at least one plane normal to either the top face, or the bottom face, or both.

8. The system according to claim 7, the plurality of debonded areas defined at least in part by a second debonding cover length measured upward from the bottom face that is between 0.5 and 1.5 times a protruded dowel length measured downward from the bottom face.

9. The system according to claim 7, the plurality of coupler bores defined at least in part by a first debonding cover length measured downward from the top face that is between 0.5 and 3.0 times a protruded dowel length.

10. The system according to claim 7, a protruded dowel length, a first debonding cover length, and a second debonding cover length each, respectively, set to the same value.

11. A method for creating a splice between driven pile segments, the method comprising the following steps:

casting an upper concrete pile segment with a multiplicity of dowels protruding from a bottom surface while a debonding area of each respective dowel inside the upper concrete pile segment is covered by a debonding layer, the debonding layer having a length measured away from the bottom surface, and debonded from the surrounding concrete, the upper concrete pile segment having a horizontal cross-section proximal the bottom surface that is formed with one or more open upper recesses on all exterior sides, the upper recesses having a specified upper recess length, a specified upper recess depth, and a multiplicity of grooves configured and adapted to provide for discharge of excess grouting or resin during splicing;

casting a lower concrete pile segment with a multiplicity of grouted sleeve couplers each respectively connected to one of a multiplicity of auxiliary bars through either threading or grout material, the lower concrete pile segment having a horizontal cross-section through the multiplicity of grouted sleeve couplers that is formed with one or more open lower recesses on all exterior sides, the lower recesses having a specified lower recess length and a specified lower recess depth, the multiplicity of grouted sleeve couplers debonded from the surrounded concrete using a low friction coating; and fabricating a fiber reinforced polymer (FRP) jacket with a jacket width and jacket length selected to cover the recesses of the upper concrete pile segment, to cover the recesses of the lower concrete pile segment, and to straddle a splice section therebetween.

12. The method according to claim 11, a length of the dowels protruding from the bottom surface, the length of the debonding area of the dowels, and the length of the recesses being set to the same value.

13. The method according to claim 11, further comprising the following steps:

driving the lower concrete pile segment into the ground at a field construction site;

applying one or more adhesive materials or resins to the lower recesses of the lower concrete pile segment;

applying one or more adhesive materials or resins to an inside perimeter of the FRP jacket; and lowering the FRP jacket onto the lower concrete pile segment while inserting the lower recesses of the lower concrete pile segment into the FRP jacket.

14. The method according to claim 13, further comprising the following steps:

pouring or injecting one or more adhesive materials or grout materials into the sleeve couplers and the top surface of the lower concrete pile segment inside the FRP jacket;

applying one or more adhesive materials or resins to the upper recesses of the upper concrete pile segment; and lowering the upper pile segment on top of the bottom pile segment while placing each respective dowel fully into a corresponding respective grouted sleeve coupler and placing each respective upper recess and each respective lower recess fully inside the FRP jacket.

15. The method according to claim 14, comprising curing the adhesive materials, resins, or grouts to complete the splice, thus generating a required bond strength.

16. The method according to claim 15, the one or more adhesive materials or grout materials comprising epoxy or cementitious-based material.

17. The method according to claim 16, the steps of casting the upper concrete pile segment, casting the lower concrete pile segment, and fabricating the FRP jacket being performed at a precast plant, remote from a job site; the remaining steps being performed at the job site.

18. The method according to claim 17, comprising transporting the upper concrete pile segment, the lower concrete pile segment, and the FRP jacket together from the precast plant to the job site.

19. A Grouted Sleeve Coupler Splice (GSCS) system for Precast Concrete Piles (PCP), the system comprising:

a bottom PCP segment comprising:

a first pile body;

a top face at a top end of the first pile body;

a first jacket recess extending downward from the top face around a periphery of the first pile body;

a plurality of coupler bores extending downward from the top face within an interior volume of the first pile body;

a plurality of sleeve couplers; each disposed within a respective coupler bore and debonded from the first pile body; and a plurality of auxiliary bars, each disposed within a respective sleeve coupler and debonded from the first pile body within the respective coupler bore and bonded to the first pile body below the respective coupler bore;

a top PCP segment comprising:

a second pile body;

a bottom face at a bottom end of the second pile body;

a second jacket recess extending upward from the bottom face around a periphery of the second pile body; and a plurality of dowels extending downward from the bottom face beyond an interior volume of the second pile body, each respective dowel debonded from the second pile body within a respective one of a plurality of debonded areas within the interior volume of the second pile body proximal to the bottom face, each respective dowel bonded to the second pile body above the corresponding respective debonded area;

a fiber reinforced polymer (FRP) jacket configured and adapted to connect the first jacket recess to the second jacket recess, forming an enclosed grout pocket connecting the top face, the plurality of coupler bores, the bottom face, and the plurality of debonded areas when the top face is brought into juxtaposition with the bottom face; and one or more grooves formed into the top PCP, the bottom PCP, or both, each respective groove connecting a space within the enclosed grout pocket surrounded by the FRP jacket to a space beyond or outside of the FRP jacket.

20. The system according to claim 19, the plurality of coupler bores arranged on the top face in a first arrangement, and the plurality of dowels arranged on the bottom face in a second arrangement that is the same as the first arrangement, such that when the top face is brought into juxtaposition with the bottom face, each respective dowel is aligned with and inserted at least partially into a corresponding respective coupler bore, the plurality of debonded areas defined at least in part by a second debonding cover length measured upward from the bottom face that is between 0.5 and 1.5 times a protruded dowel length measured downward from the bottom face;

the plurality of coupler bores defined at least in part by a first debonding cover length measured downward from the top face that is between 0.5 and 3.0 times the protruded dowel length;

the protruded dowel length, the first debonding cover length, and the second debonding cover length each, respectively, set to the same value.

* * * * *